US006183360B1

(12) United States Patent
Luter, II et al.

(10) Patent No.: US 6,183,360 B1
(45) Date of Patent: Feb. 6, 2001

(54) MOLDED ROOF EXHAUST VENT

(75) Inventors: Robert J. Luter, II; Matthew J. Copeland, both of Elkhart, IN (US)

(73) Assignee: Philips Products, Inc., Elkhart, IN (US)

( * ) Notice: Under 35 U.S.C. 154(b), the term of this patent shall be extended for 0 days.

(21) Appl. No.: 09/347,751

(22) Filed: Jul. 6, 1999

(51) Int. Cl.[7] ..... F24F 7/04
(52) U.S. Cl. ..... 454/366; 454/82; 454/367
(58) Field of Search ..... 454/78, 82, 366, 454/367, 136

(56) References Cited

U.S. PATENT DOCUMENTS 2,550,353 * 4/1951 Hopfinger ..... 454/136
3,062,125 * 11/1962 Henneberger ..... 454/82
3,524,400 * 8/1970 Magi ..... 454/78
3,779,149 * 12/1973 Bernard, Jr. ..... 454/78 X
4,050,363 * 9/1977 Fuerst ..... 454/78
4,297,818 * 11/1981 Anderson ..... 454/366 X
4,592,269 * 6/1986 Lamparter ..... 454/136 X
4,895,065 * 1/1990 Lamparter ..... 454/136
5,662,522 * 9/1997 Waltz ..... 454/367 X

* cited by examiner

*Primary Examiner*—Harold Joyce
(74) *Attorney, Agent, or Firm*—Biebel & French

(57) ABSTRACT

An exhaust vent including a roof cap inlet and a roof cap outlet which are joined together without the use of fasteners and which defines a vent for use in venting gases from the inside of a building structure. The roof cap inlet includes a base portion defining an aperture and including a cylindrical extension extending below the base portion for attachment to a duct, and a rectangular extension extending above the base portion for preventing ingestion of water through the aperture. The roof cap outlet is formed with a semicircular portion defining a flow passage and includes a hemispherical portion defining a closed end for the flow passage wherein the design of the roof cap outlet provides increased strength against deformation, and the hemispherical and semicircular shape of the roof cap outlet facilitates flow of gases through the exhaust vent to the outlet opening.

11 Claims, 7 Drawing Sheets

MOLDED ROOF EXHAUST VENT

BACKGROUND OF THE INVENTION

The present invention relates generally to a ventilating apparatus and, more particularly, to a roof exhaust vent which is adapted to discharge gases from within a building structure.

Building constructions are often designed with rooms having a ventilator fan designed to discharge air and gases from within the room. For example, rooms within the house including kitchens and bathrooms often require means for discharging undesirable fumes and gases from the room, and generally include a vent opening associated with a ventilating fan which extracts the gases from within the room, and typically ducts the gases to a roof or wall vent structure on the exterior of the building.

The exterior vent structure is typically formed with a connector for connecting to duct work extending from the ventilating fan and includes a cover element which extends over the opening to prevent exposure of the opening to elements such as wind and rain. Several prior art exhaust vents include a lower portion which is adapted to attach to a ventilation duct, and which may include integral flashing, and a separate upper cover piece for covering the outlet to the duct opening. One problem associated with prior art devices is the need to assemble the devices, such as placing the cover portion in association with the lower duct attachment portion, using fasteners, which contributes to increased installation time for mounting the exhaust vent to a building structure.

In addition, as a result of forming exhaust vents with planar surfaces, the vent structures are subject to bending and/or breakage, such as if a worker inadvertently steps on the vent structure, or if the vent structure has been struck by an object when located in its operating position on the building structure.

In view of the above noted characteristics of prior art vent structures, it is desirable to provide a vent structure which reduces installation time, and which further is resistant to deformation and breakage when in use.

SUMMARY OF THE INVENTION

The present invention provides an exhaust vent which is adapted to be mounted to a building structure, such as a roof, and which includes means for attaching the exhaust vent to a duct whereby exhaust gases may be vented from a location inside the building structure to the exterior. The exhaust vent includes a roof cap inlet, a roof cap outlet which is frictionally attached to the roof cap inlet, and a grill or louver member which is held captive between the roof cap inlet and the roof cap outlet.

The roof cap inlet includes a substantially planar base portion defined by opposing, generally parallel first and second side edges, a front edge and a rear edge. An aperture is formed through the base portion adjacent to the rear edge, and a cylindrical extension extends from a lower surface of the base portion at the aperture for connection to a tubular duct member. The roof cap inlet further includes a rectangular extension extending from an upper surface of the base portion a sufficient distance to prevent ingestion of water through the aperture into the duct member.

The roof cap inlet also includes attachment and sealing means located around the upper periphery thereof. The attachment and sealing means includes a flange portion extending upwardly from the upper surface along the first, second and rear edges. and a plurality of elongated tabs extending upwardly from the flange portion for engaging with cooperating sockets formed in the roof cap outlet.

The roof cap outlet includes semicircular portion which. in cooperation with the base portion of the roof cap inlet, defines a flow passage. A hemispherical portion of the roof cap outlet defines a closed end for the closed passage. The semicircular portion includes opposing generally parallel side walls, and the hemispherical portion includes a semicircular rear wall contiguous with the side walls wherein the side walls and semicircular rear wall define a recess for receiving the flange portion of the roof cap inlet to thereby facilitate sealing between the roof cap outlet and roof cap inlet. In addition. the sockets for receiving the elongated tabs of the attachment and sealing means are defined along lower portions of the side walls and semicircular rear wall of the roof cap outlet adjacent to the recess. The tabs are received in the sockets in frictional engagement whereby the roof cap outlet is held in place on the roof cap inlet without requiring fasteners.

The roof cap outlet further includes a roof flashing formed integrally with the side walls and semicircular rear wall. A profile defined by the intersection line between the roof flange and the side walls and rear wall of the roof cap outlet matches the profile of the roof cap inlet, in plan view, and the lower surface of the roof cap inlet base portion is substantially coplanar with a lower surface of the flange.

Therefore, it is an object of the present invention to provide an exhaust vent which facilitates assembly and installation of the vent.

It is a further object of the invention to provide an exhaust vent having a simple and durable construction for the terminal end of a duct conduit.

Other objects and advantages of the invention will be apparent from the following description and the accompanying drawings.

DETAILED DESCRIPTION OF THE PREFERRED EMBODIMENT

Figure 1:
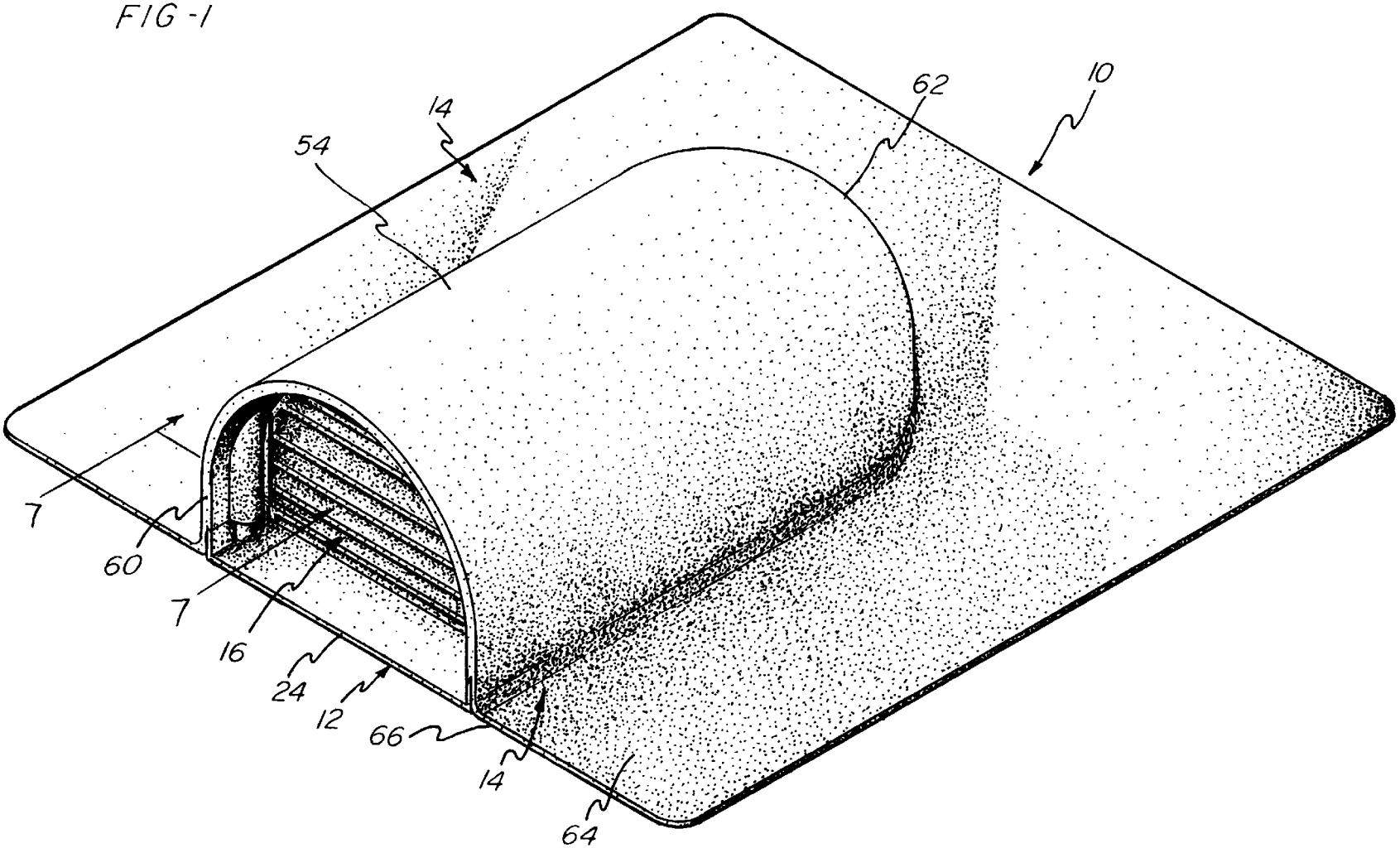
FIG. 1 is a top perspective view of the molded exhaust vent of the present invention.
Figure 2:
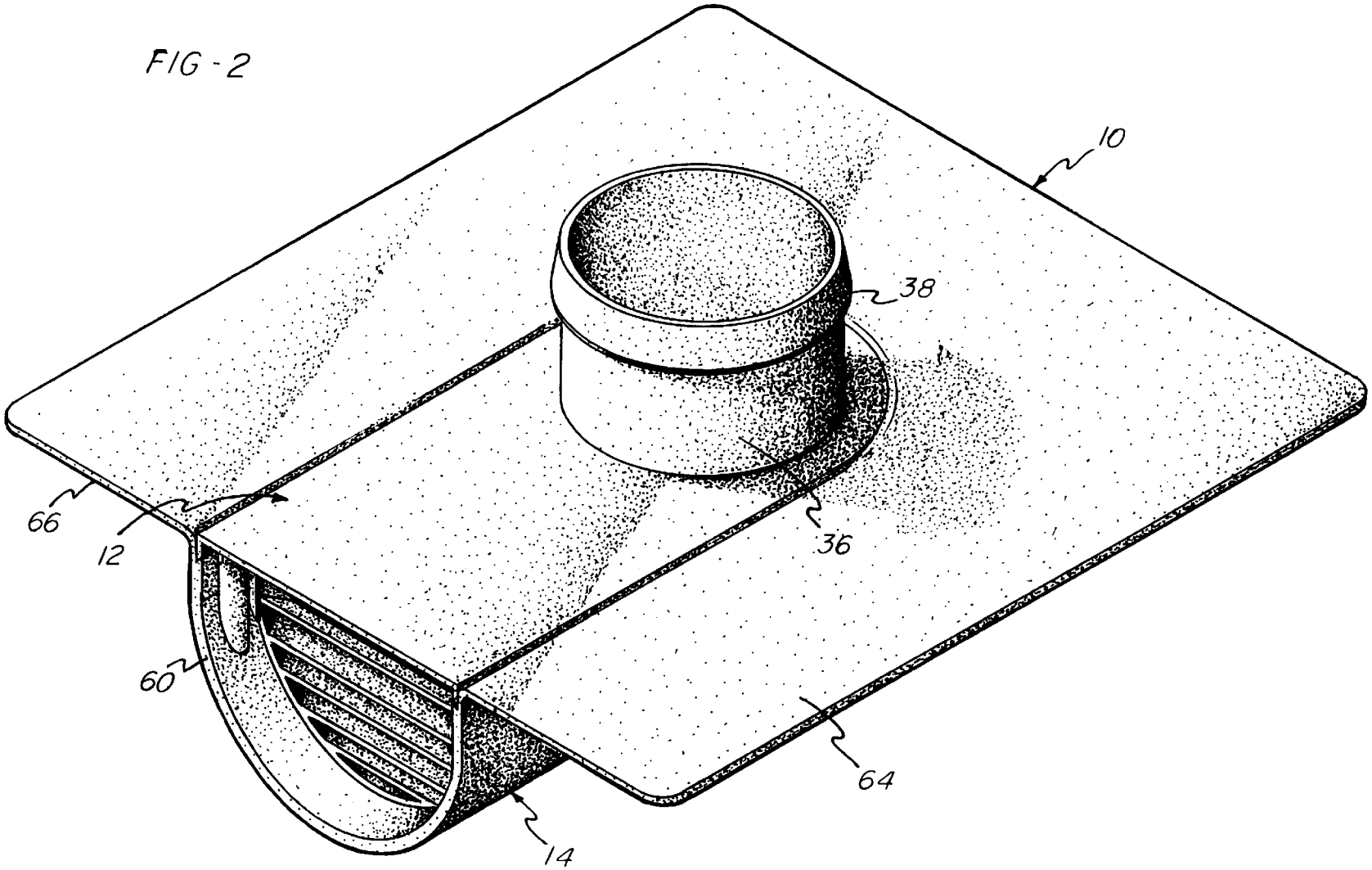
FIG. 2 is a bottom perspective view thereof.
Figure 3:
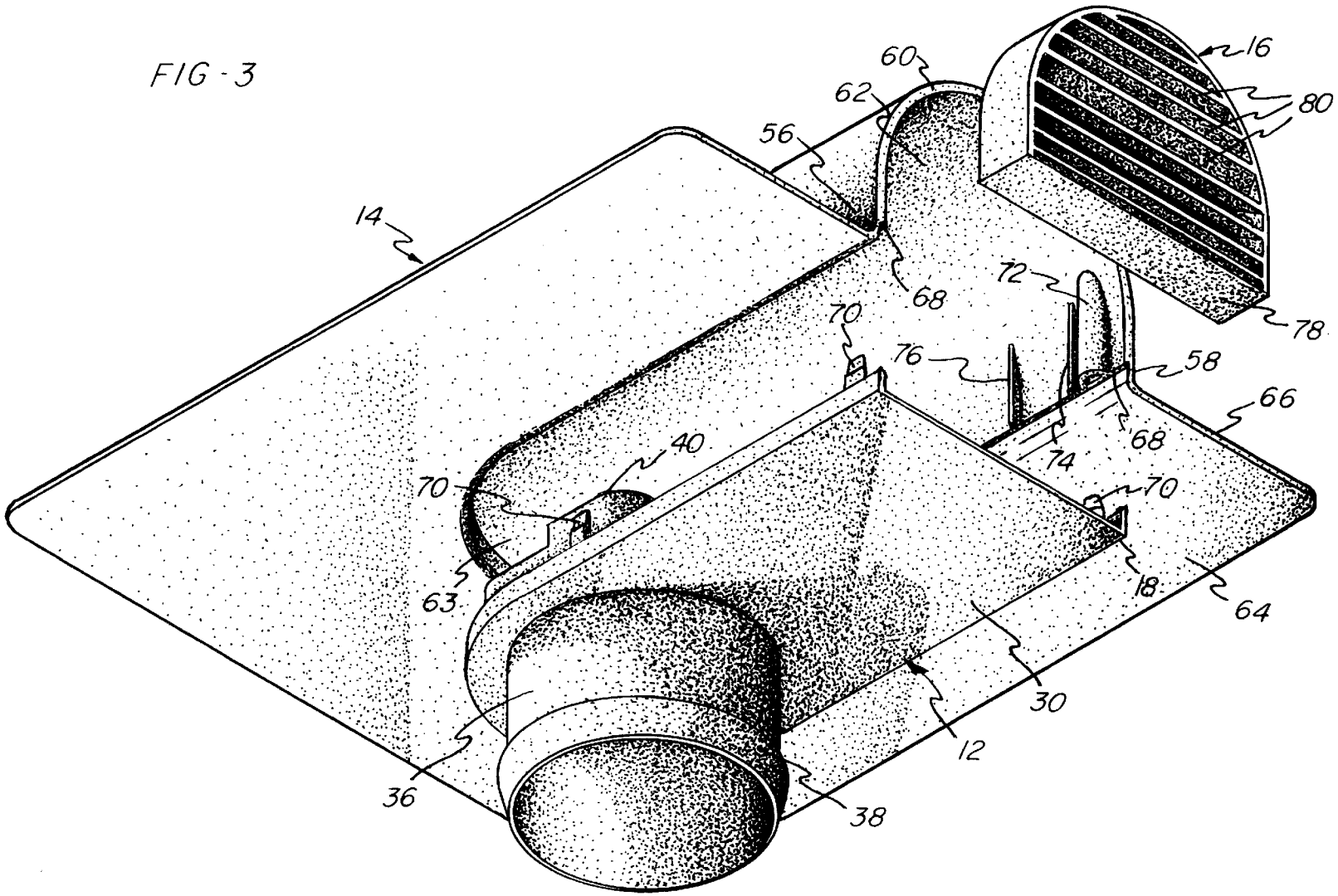
FIG. 3 is a bottom perspective exploded view of the exhaust vent.

Referring initially to FIGS. 1–3, the present invention provides an exhaust vent 10 which is particularly designed for installation on the roof of a building structure, but which may also be used as a vent on other portions of the building, such as on a wall. The exhaust vent 10 includes a roof cap inlet 12, a roof cap outlet 14 and a grill member 16 which is held in position between the roof cap inlet 12 and the roof cap outlet 14.

Figure 4:
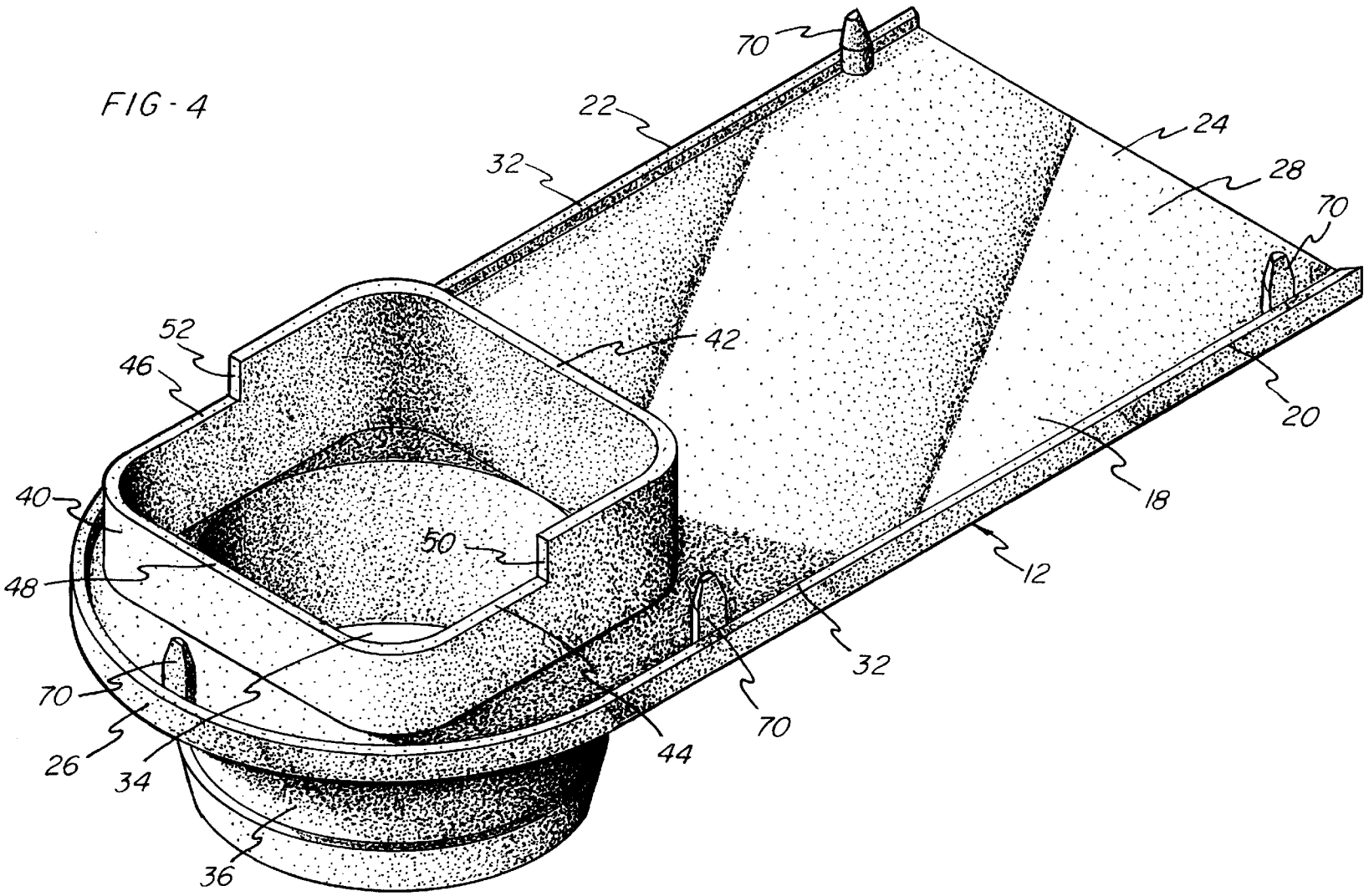
FIG. 4 is a top perspective view of the roof cap inlet for the exhaust vent.

Referring further to FIG. 4, the roof cap inlet 12 includes a substantially planar base portion 18 defined by opposing, generally parallel first and second side edges 20, 22, a front edge 24 and a semicircular rear edge 26. The roof cap inlet 12 defines an upper surface 28 and a lower surface 30 wherein a flange portion 32 extends upwardly from the upper surface 28 along the first, second and rear edges 20, 22 and 26.

A circular aperture 34 is defined through the base portion 18 adjacent to the rear edge 26, and a cylindrical extension 36 extends from the lower surface 30 at the aperture 34 to define a duct connection. The cylindrical extension 36 includes a circumferential barb portion 38 adjacent to a lower end of the extension 36 to facilitate retention of a tubular duct member thereto.

The roof cap inlet 12 further includes a rectangular extension 40 attached to and extending from the upper surface 28 of the base portion 18. The rectangular extension 40 defines a larger cross sectional area than the cylindrical extension 36, and provides a distinct expansion area for gases passing out of the cylindrical extension 36. The rectangular extension 40 further provides a barrier for inhibiting passage of water through the exhaust vent 10 into the cylindrical extension 36, as will be further discussed below.

The rectangular extension 40 is formed with a front wall 42, opposing side walls 44, 46, and a rear wall 48. The rear wall 48 and rear half of each of the side walls 44, 46 are defined by a height dimension which is less than the height dimension of the front wall 42 and front half of each of the side walls 44, 46, and is demarcated by a distinct transition edge 50, 52 on each of the walls 44, 46, respectively. The reduced height dimension of the rear wall and rear halves of side walls 44, 46 provides for increased gas flow from the rectangular extension 40, while the remaining front halves of the side walls 44, 46 and the front wall 42 provides a dimension for ensuring that ingestion of water into the duct work through the aperture 34 is inhibited.

Referring to FIGS. 1–3, 5 and 6, the roof cap outlet 14 includes an arched or semicircular portion 54 extending in a longitudinal direction and which, in combination with the upper surface 28 of the base portion 18 defines a flow passage extending from the aperture 34 to the front edge 24 of the base portion 18. The semicircular portion 54 includes opposing generally parallel side walls extending rearwardly from a front border or edge 60 of the semicircular portion 54 to a hemispherical portion 62 which defines a closed end for the flow passage and which at a lower portion thereof defines a semicircular rear wall 63 contiguous with the side walls 56, 58.

The roof cap outlet 14 also includes a generally planar roof flashing 64 formed integral with the semicircular and hemispherical portions 54 and 62, and extends in a plane coplanar with lower edge portions of the side walls 56, 58 and the semicircular rear wall 63. The roof flashing 64 includes a front border 66 which is contiguous with the front border or edge 60 of the semicircular portion 54 to define an open front end for the flow passage.

Figure 5:
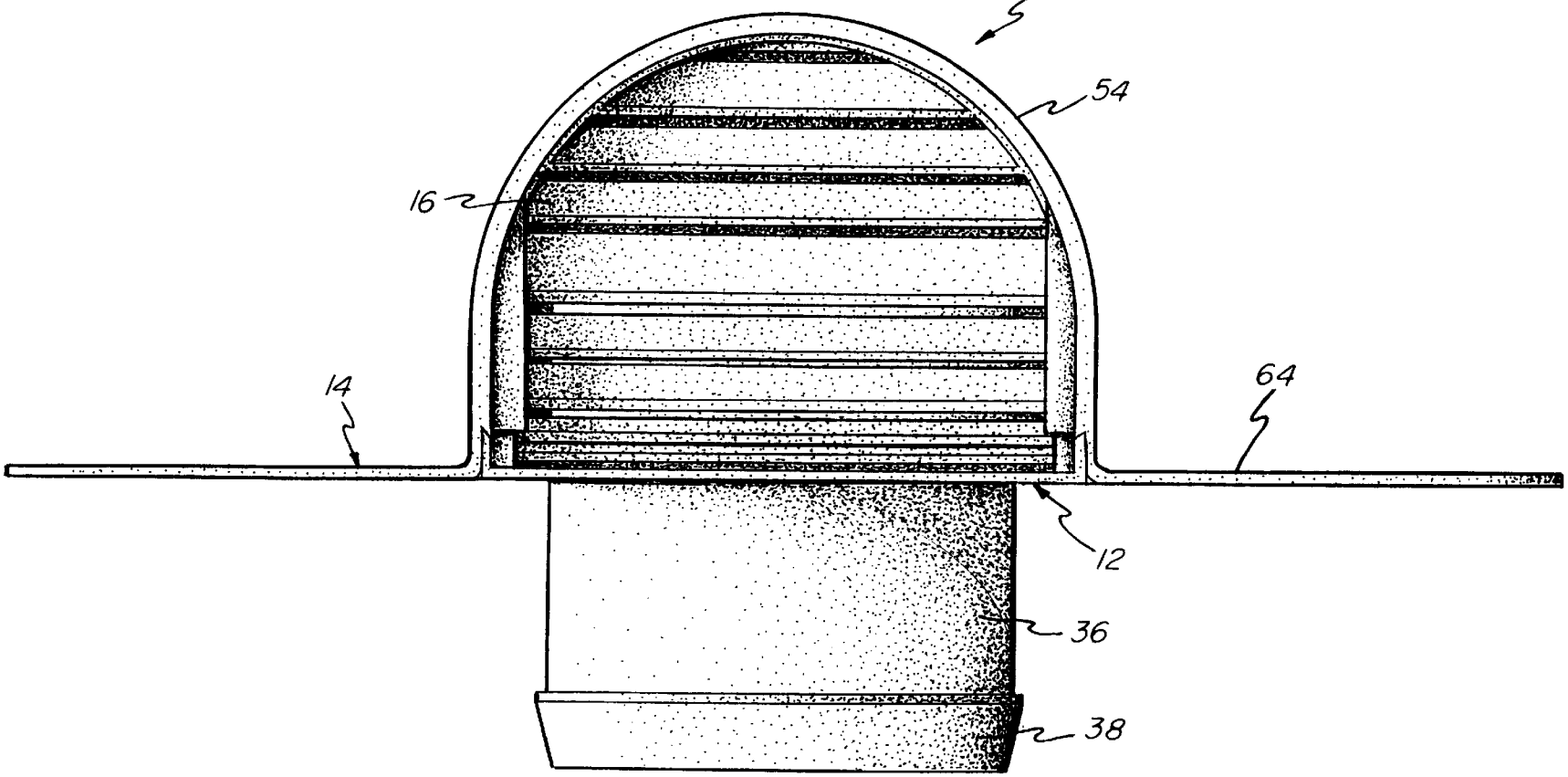
FIG. 5 is a front elevational view of the exhaust vent.
Figure 6:
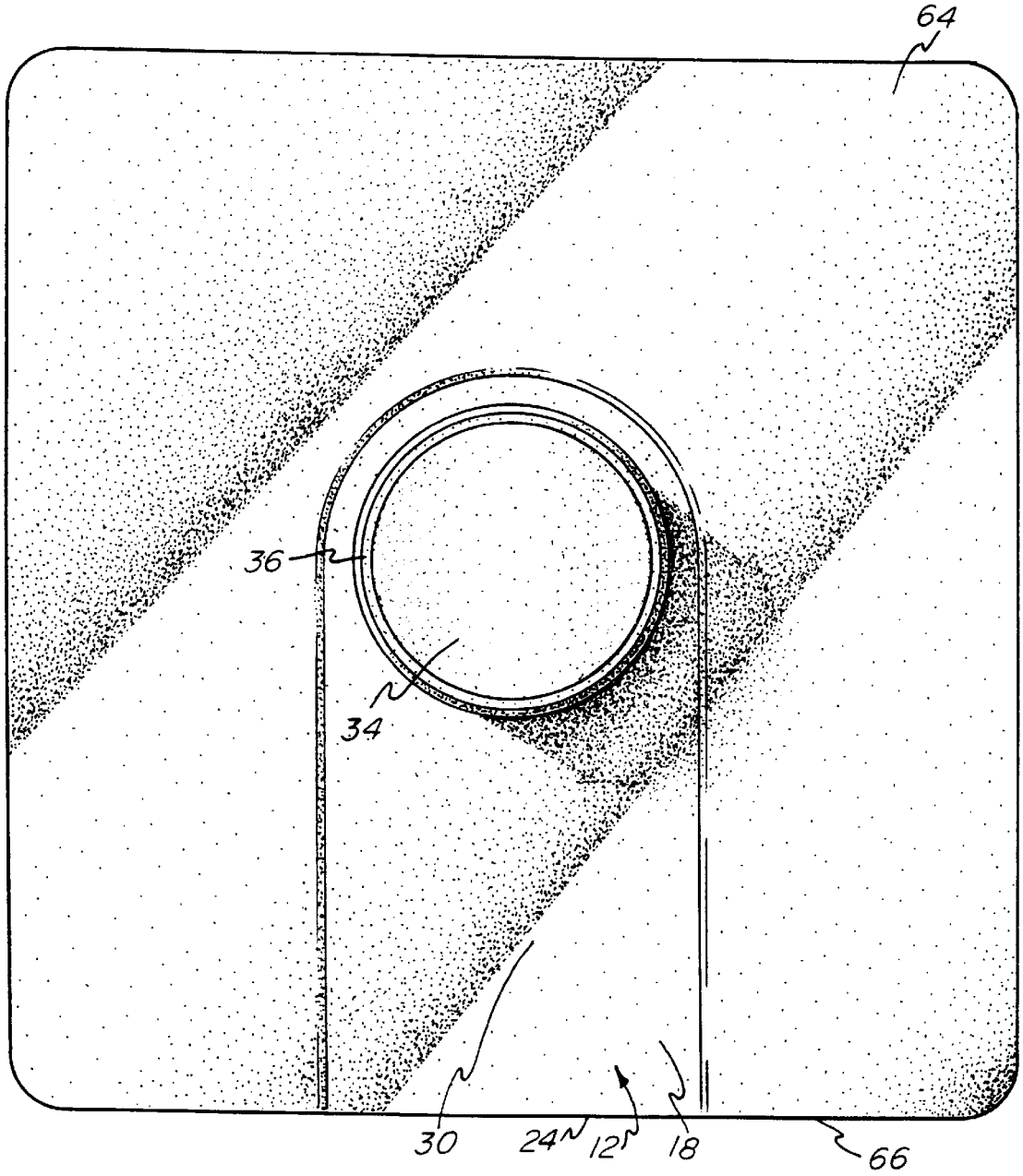
FIG. 6 is a bottom plan view of the exhaust vent.

Referring in particular to FIGS. 2, 5 and 6, it should be noted that the plan view profile of the roof cap inlet 12, as defined by the side edges 20, 22, front edge 24 and rear edge 26 is substantially identical to the plan view profile defined by the lower edges of the side walls 56, 58, front edge 60, and semicircular rear wall 63 of the roof cap outlet 14, such that when the roof cap outlet 14 is assembled to the roof cap inlet 12, the lower surface 30 of the base portion 18 is substantially coplanar with the lower surface of the roof flashing 64 to define a planar surface for resting on the roof of a building structure to which the exhaust vent 10 is mounted.

Figure 7:
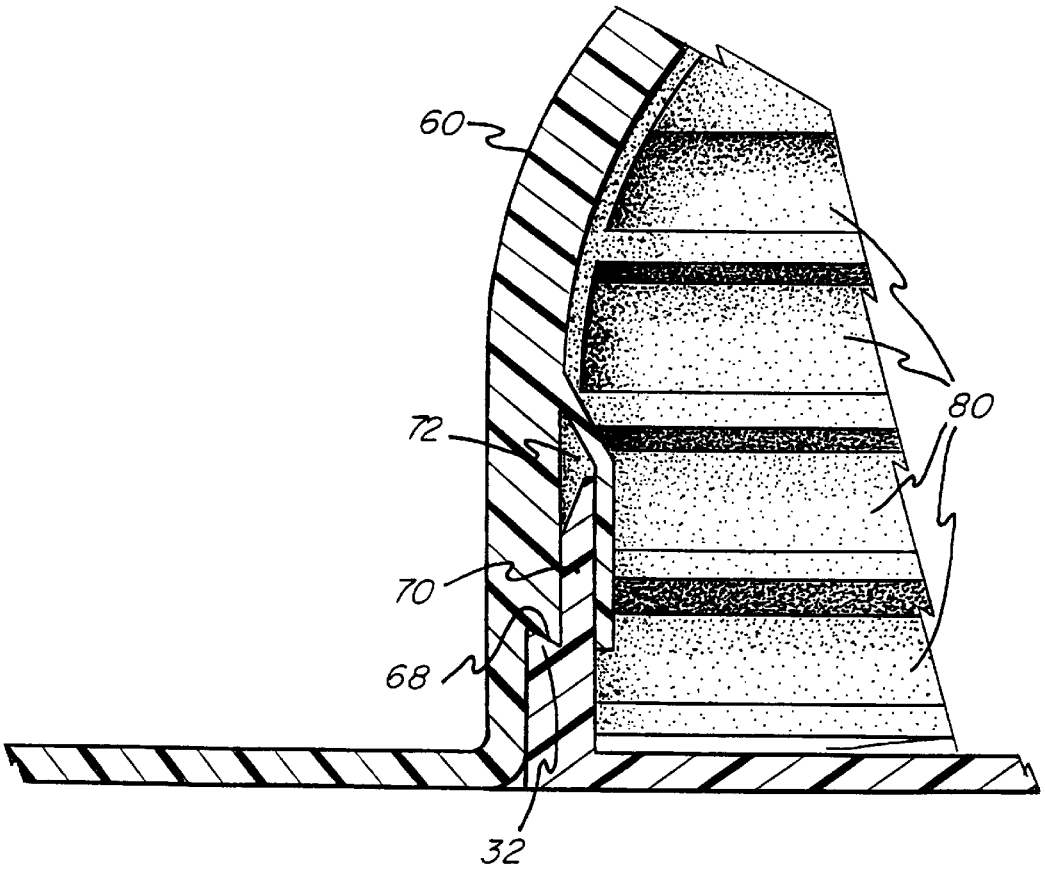
FIG. 7 is a cross-sectional view taken along line 7–7 in FIG. 1.

Referring to FIGS. 3 and 7, the joint between the roof cap inlet 12 and roof cap outlet 14 is defined by a recess 68 formed in the roof cap outlet 14 and extending around the lower portions of the side walls 56, 58 and rear wall 63 wherein the recess 68 comprises an upwardly angled slot for receiving a correspondingly shaped upwardly angled edge on the flange portion 32 of the base portion 18. Thus, a sealing joint is defined between the roof cap inlet 12 and the roof cap outlet 14.

In order to lock the roof cap inlet 12 in position in association with the roof cap outlet 14, a plurality of elongated tabs 70 are provided on the base portion 18 extending upwardly from the flange portion 32 for reception in corresponding sockets 72 formed on the interior of the side walls 56, 58 of the roof cap outlet 14. The tabs 70 engage the sockets 72 in frictional engagement to positively lock the roof cap inlet 12 in position on the roof cap outlet 14 without requiring the use of separate fasteners.

As may be best seen in FIG. 3, the roof cap outlet 14 is formed with a pair of spaced inwardly extending ribs 74, 76 on the inner surface of each of the side walls 56, 58. The ribs 74, 76 are spaced apart a distance approximately equal to the width of the grill 16 whereby the ribs 74, 76 define a cavity to hold the grill 16 at a predetermined longitudinal position within the flow passage defined by the semicircular portion 54. Further, the upper surface 28 of the base portion 18 engages a lower surface 78 of the grill 16 to lock the grill 16 in its position when the roof cap inlet 12 has been assembled together with the roof cap outlet 14. The grill 16 includes a plurality of louvers 80, the upper half of which are upwardly angled, and the lower half of which are downwardly angled, to prevent ingestion of foreign objects and/or water into the exhaust vent 10 while permitting gases to freely flow from the vent.

It should be noted that each of the separate components, including the roof cap inlet 12, the roof cap outlet 14 and the grill 16 are preferably formed as integrally molded components, and the components are preferably molded of a plastics material such as UV stabilized polypropylene. Further, it should be understood that by integrally molding the roof flashing 64 with the upwardly extending semicircular portion 54 and hemispherical portion 62, the present roof vent structure provides a configuration which readily prevents water from leaking to the inside of the vent structure, for example, as water runs down a roof toward the back of the vent structure at the hemispherical portion 62.

Also, it should be understood that by providing a semicircular shape 54 and hemispherical shape 62 for the upwardly extending portion of the vent structure, the present vent has increased structural rigidity, as opposed to prior art vent structures, thereby providing greater resistance to breakage and/or deformation in the event that a force is applied to the upwardly extending portions of the vent. Additionally, the hemispherical area 62 operates to direct outflow of gases wherein the smooth contour of the hemispherical portion 62 provides for improved air flow toward the outlet of the vent.

Finally, it should be noted that the rectangular structure is designed to facilitate both outflow of gases as well as prevent ingestion of water in that approximately the rear half of the rectangular extension 40 is provided with a lower height than the front half to reduce restriction of gas flow wherein the reduced height portion of the extension 40 approximately corresponds to the location of the hemispherical portion 62 of the roof cap outlet 14 and the increased height portion of the extension 40 approximately corresponds to an area of the semicircular portion 54 forwardly of the hemispherical portion 62. Thus, while the rear portion of the rectangular extension 40 is cut down to facilitate flow of gases around the hemispherical portion 62, the forward portion of the rectangular extension 40 extends to a height sufficient to minimize ingestion of water into the aperture 30 of the vent.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An exhaust vent comprising:

a roof cap inlet including a substantially planar base portion defined by opposing, generally parallel first and second side edges, a front edge and a semicircular rear edge, and said roof cap inlet including an upper surface and a lower surface;

an aperture formed through said base portion of said roof cap inlet adjacent said semicircular rear edge for passage of gasses through said base portion;

a roof cap outlet including a semicircular portion defining a flow passage and including a hemispherical portion defining a closed end for said flow passage located adjacent said semicircular rear edge of said roof cap inlet, said semicircular portion including opposing, generally parallel side walls, and said hemispherical portion including a semicircular rear wall contiguous with said side walls;

locking means for locking said roof cap outlet in association with said roof cap inlet; and including an extension portion extending upwardly from said upper surface of said roof cap inlet and surrounding said aperture, said extension portion including a rearward upper edge located generally rearwardly of the semicircular portion of the roof cap outlet adjacent said hemispherical portion, and a forward upper edge located generally forwardly of the hemispherical portion of the roof cap outlet adjacent said semicircular portion and extending above said upper surface of said base portion a distance greater than the distance from said upper surface of said base portion to said rearward upper edge.

2. The exhaust vent of claim 1 including a cylindrical extension extending from said lower surface at said aperture in said roof cap inlet and defining a duct connection.

3. The exhaust vent of claim 1 wherein said base portion includes a rectangular extension extending from said upper surface at said aperture in said roof cap inlet to prevent ingestion of water through said aperture.

4. The exhaust vent of claim 1 wherein said base portion includes a flange portion extending upwardly from said upper surface along said first and second edges, and said roof cap outlet includes a recess formed in lower portions of said side walls for receiving said flange portion.

5. The exhaust vent of claim 1 including a generally planar roof flashing formed integral with said semicircular and said hemispherical portions and extending outwardly therefrom.

6. The exhaust vent of claim 1 wherein said locking means comprises elongated tabs extending upwardly from said base portion of said roof cap inlet, and sockets formed in said roof cap outlet for receiving said tabs in frictional locking engagement.

7. An exhaust vent comprising:

a roof cap inlet including a substantially planar base portion, said roof cap inlet including an upper surface and a lower surface, an aperture formed through said base portion of said roof cap inlet, a cylindrical extension extending from said lower surface at said aperture and defining a duct connection;

a roof cap outlet adapted to attach over said roof cap inlet to thereby define a flow passage, said roof cap outlet including a semicircular portion defining a flow passage and including a hemispherical portion defining a closed end for said flow passage, said semicircular portion including opposing, generally parallel side walls, and said hemispherical portion including a semicircular rear wall contiguous with said side walls;

attachment elements connecting said roof cap outlet to said roof cap inlet; and including a generally planar roof flashing formed integral with said roof cap outlet, said roof flashing extending continuously along lower edges of said generally parallel side walls and said semicircular wall of said hemispherical portion and extending outwardly beyond a peripheral edge of said base portion.

8. The exhaust vent of claim 7 including an extension portion extending upwardly from said upper surface of said base portion and surrounding said aperture, said extension portion including a rearward upper edge located adjacent said hemispherical portion and a forward upper edge located adjacent said semicircular portion wherein said forward upper edge extends above said upper surface of said base portion a distance greater than the distance from said upper surface of said base portion to said rearward upper edge.

9. The exhaust vent of claim 7 including a rectangular extension extending from said upper surface of said roof cap inlet at said aperture to prevent ingestion of water through said aperture.

10. An exhaust vent comprising:

a roof cap inlet including a substantially planar base portion defined by opposing, generally parallel first and second side edges, a front edge and a rear edge, said roof cap inlet including an upper surface and a lower surface, a flange portion extending upwardly from said upper surface along said first, second and rear edges, an aperture formed through said base portion of said roof cap inlet adjacent said rear edge, a cylindrical extension extending from said lower surface at said aperture and defining a duct connection, and a rectangular extension extending from said upper surface at said aperture to prevent ingestion of water through said aperture;

a roof cap outlet including a semicircular portion defining a flow passage and including a hemispherical portion defining a closed end for said flow passage, said semicircular portion including opposing, generally parallel side walls, and said hemispherical portion including a semicircular rear wall contiguous with said side walls, a generally planar roof flashing formed integral with said semicircular and said hemispherical portions and extending in a plane coplanar with lower portions of said side walls and said rear wall, said roof flashing including a front border which is contiguous with a front border of said semicircular portion to define an open front end for said flow passage, and a recess formed in said lower portions of said side walls and said rear wall for receiving said flange portion of said roof cap inlet;

said rectangular extension including a rearward upper edge located adjacent said hemispherical portion and a forward upper edge located adjacent said semicircular portion wherein said forward upper edge extends above said upper surface of said base portion a distance greater than the distance from said upper surface of said base portion to said rearward upper edge; and locking means locking said roof cap outlet in association with said roof cap inlet, said locking means comprising elongated tabs extending upwardly from said flange portion of said roof cap inlet and sockets formed in said roof cap outlet for receiving said tabs in frictional locking engagement.

11. The exhaust vent of claim 10 including a grill formed separately from said roof cap inlet and said roof cap outlet, said semicircular portion of said roof cap outlet including means defining a cavity for receiving side edges of said grill to thereby retain said grill in position within said exhaust vent when said roof cap outlet is positioned in association with said roof cap inlet.

* * * * *